US007497418B1

(12) United States Patent
Mei et al.

(10) Patent No.: US 7,497,418 B1
(45) Date of Patent: Mar. 3, 2009

(54) POSITIONING UNIT OF A CARPET KICKER

(76) Inventors: Tzu-Chiang Mei, 5th Floor, No. 28, Alley 401, Lane 150, Hsin I Road, Sec. 5, Taipei City (TW); Da-Peng Mei, 5th Floor, No. 28, Alley 401, Lane 150, Hsin I Road, Sec. 5, Taipei City (TW)

( * ) Notice: Subject to any disclaimer, the term of this patent is extended or adjusted under 35 U.S.C. 154(b) by 0 days.

(21) Appl. No.: 11/892,988

(22) Filed: Aug. 29, 2007

(51) Int. Cl.
*B25B 25/00* (2006.01)

(52) U.S. Cl. ..... 254/205; 294/8.6

(58) Field of Classification Search ..... 254/201, 254/203, 205, 209, 211; 294/8.6
See application file for complete search history.

(56) References Cited

U.S. PATENT DOCUMENTS

| | | | | | |
|---|---|---|---|---|---|
| 670,947 | A * | 4/1901 | Briggs | 254/205 |
| 1,929,837 | A * | 10/1933 | Cathcard | 254/205 |
| 4,042,211 | A * | 8/1977 | Hammond et al. | 254/201 |
| 4,084,787 | A * | 4/1978 | Kowalczyk | 254/201 |
| 5,145,225 | A * | 9/1992 | Muller et al. | 294/8.6 |
| 5,228,660 | A * | 7/1993 | Massicotte | 254/201 |
| 5,626,329 | A * | 5/1997 | Herdan | 254/200 |
| 5,664,764 | A * | 9/1997 | Ruppricht | 254/209 |
| 6,371,446 | B1 * | 4/2002 | Gauthier et al. | 254/201 |
| 7,140,597 | B2 * | 11/2006 | Chien | 254/201 |
| 7,159,850 | B2 * | 1/2007 | Peters | 254/201 |
| 7,222,898 | B1 * | 5/2007 | Mei | 294/8.6 |

* cited by examiner

*Primary Examiner*—Emmanuel M Marcelo
(74) *Attorney, Agent, or Firm*—Rosenberg, Klein & Lee

(57) ABSTRACT

A positioning unit of a carpet kicker having a housing with a rear end having a receiving element into which a 7-shaped hook member is engaged. The 7-shaped hook member includes a shorter internal portion for engaging into the receiving element in place and a longer external portion for leaning against a wall in an upright state. A flat hook portion is formed at the bottom of the external portion. The 7-shaped hook member includes a plurality of strengthening ribs that are arranged in a non-flat and parallel manner in a vertical direction. In this way, a more convenient human machine operation interface is ensured. Moreover, it is avoidable that an inclined position is created by a single point reacting force during the operation of the kicker. Accordingly, the carpet may be smoothly pulled and spread on the floor in place.

5 Claims, 11 Drawing Sheets

POSITIONING UNIT OF A CARPET KICKER

BACKGROUND OF THE INVENTION

1. Field of the Invention

The invention generally relates to a positioning unit of a carpet kicker, and more particularly to a carpet kicker that can protect the kicker from being inclined in laying a carpet, such that the carpet can be pulled, spread and fixed smoothly on the floor.

2. Description of the Related Art

Carpets are commonly laid on the floor of our home or office and give us an indoor warm and comfortable feeling. However, carpets must be laid evenly and smoothly on the floor, or else the carpets will be uneven, not only affecting its appearance, but also creating a problem of stumbling people easily.

If a large carpet is laid, a user usually cannot pull and spread the thick and heavy carpet smoothly by hands, and thus a carpet kicker is needed for the job.

Referring to FIG. 1, a prior art carpet kicker 70 is used to hold a free end of a carpet 62 to push it towards a pin board 60 at a wall, and the carpet kicker 70 includes a rectangular main body 71, a kicking unit 72 installed at a front end of the main body 71, a plurality of protruding pins 73 disposed at the bottom surface of the kicking unit 72 for hooking and pulling the carpet 62. The height of the protruding pin 73 can be controlled by a knob 74. The main body 11 includes a cushion 75 disposed at an end of the main body 11, and carpet kickers of this sort are disclosed in U.S. Pat. No. 3,374,023.

When the carpet kicker 70 is in use, a user presses the main body 71 by hands, and pushes the cushion 75 in the arrowed direction by knees, such that the kicking unit 72 holds and moves the carpet 62 gradually towards a pin board 60 on a wall, and finally hooks an edge of the carpet 62 to a hook pin 61 of the pin board 60 to spread and fix the carpet 62. However, such method is time-consuming and laborious, and using knees to push the cushion 75 for a long time will become an issue of professional safety.

Referring to FIGS. 2 and 3 for another prior art carpet kicker 80, the carpet kicker 80 comprises an air pressure input end 81 connected to an air compressor 90 for providing air pressure to a housing 83 through a handle 82. The housing 83 includes a piston (not shown in the figure) for controlling a piston rod 85 to move forward and backward axially, and an external end of the piston rod 85 is connected to a hooking rod 86, and the bottom of the hooking rod 86 includes a hook 861. Further, a kicking unit 84 is installed at the bottom of a front end of the housing 83. Although the carpet kicker 80 intends to pull the carpet 62 pneumatically, its application still has the following problems:

1. Since the piston is driven pneumatically to move the piston rod 85, therefore an external air compressor 90 is needed to supply air pressure which is inconvenient to users. In other words, users have to carry a heavy and expensive air compressor 90 for the use of the carpet kicker 80, and it thus makes the application impractical.

2. Since the interval D between a pin board 60 for fixing the carpet 62 and a skirting board 64 at the wall is only 5 mm~10 mm, and the design does not allow the hook 861 to be installed within the interval D, and it often makes the carpet kicker 80 useless. If the interval D of the pin board 60 is increased to allow the installation of the hook 861, the carpet will produce creases easily and affect the appearance of the carpet adversely.

3. More importantly, the carpet kicker 80 uses the hooking rod 86 to hook a fixed end of the pin board 60, and then the piston board 85 is moved back and forth to pull components such as the housing 83, handle 82 and kicking unit 84 indicated by dotted lines in the figure to move towards the wall synchronously. Furthermore, the method of using the protruding pin 841 to drive and pull the carpet 62 towards the pin board 60 is not too practical, because all of the actions for hooking and pulling the carpet 62 are centralized at the hook 861, and the pin board 60 is lifted by the hook 861 when the carpet 62 has not been pulled evenly yet. Therefore, such method of pulling the carpet still has its inevitable drawbacks and requires further improvements.

4. The front end 621 has to be lifted in direction of the phantom line for at least 50-100 mm for the hooking and positioning purpose when the kicking unit 84 pulls the carpet 62 in direction of the top of the pin board 60 for positioning the hook pin 61 of the pin board 60 in place. The redundant front end 621 of the carpet 62 will be cut off after the carpet leans against the wall corner. However, the conventional hooking rod 86 will hinder a smooth and natural upward lifting action, thereby affecting the further positioning work. As a result, it is not easy to flatten the carpet 62 for a nice appearance.

According to U.S. Pat. No. 7,222,898, a carpet kicker disclosed by the inventor of the invention is illustrated in FIGS. 4 and 5. The carpet kicker mainly includes a housing 100, and a motive power device 110. The motive power device 110 is installed within the housing 100 for driving a gear rack 120 and a kicking unit 130 in displacement. Moreover, a positioning device 200 consisting of a connecting board 210, a L-shaped board 220, and a braking element 230 is disposed at a rear end of the housing 100. However, this structure is not optimal in use. For example, the L-shaped board 220 is easily deformed due to the insufficient strength thereof. Besides, it is impractical in operation when the horizontal short side 221 at the bottom thereof is hooked at the bottom rim of the skirting board 64. Furthermore, the vertical short side 222 of the L-shaped board 220 does not lean against the wall, thereby creating an instable state or bringing it into an inclined position due to the action of the whole machine to concentrate at the position of the horizontal short side 221. Meanwhile, the skirting board 64 is easily lifted. In addition, the above-mentioned drawbacks is present when the front end 621 of the carpet 62 is lifted, that is, the carpet 62 is jammed due to the insufficient space for the lifting action.

SUMMARY OF THE INVENTION

Therefore, it is a primary object of the present invention to provide a positioning unit of a carpet kicker that ensures a more convenient human machine operation interface. Moreover, it is avoidable that an inclined position is created by a single point reacting force during the operation of the kicker. Accordingly, the carpet may be smoothly pulled and spread on the floor in place.

Another object of the present invention is to provide a positioning unit of a carpet kicker that includes a non-deformable 7-shaped hook member with great strength. The 7-shaped hook member ensures a sufficient space for the lifting action of the carpet head, thereby achieving the effect of spreading the carpet more evenly and smoothly.

In order to achieve the above-mentioned objects, a positioning unit of a carpet kicker includes a housing with a rear end having a receiving element into which a 7-shaped hook member is engaged. The 7-shaped hook member includes a shorter internal portion for engaging into the receiving element in place and a longer external portion for leaning against a wall in an upright state. A flat hook portion is formed at the bottom of the external portion. The 7-shaped hook member includes a plurality of strengthening ribs that are arranged in a non-flat and parallel manner in a vertical direction.

DETAILED DESCRIPTION OF THE PREFERRED EMBODIMENT

Figure 6:
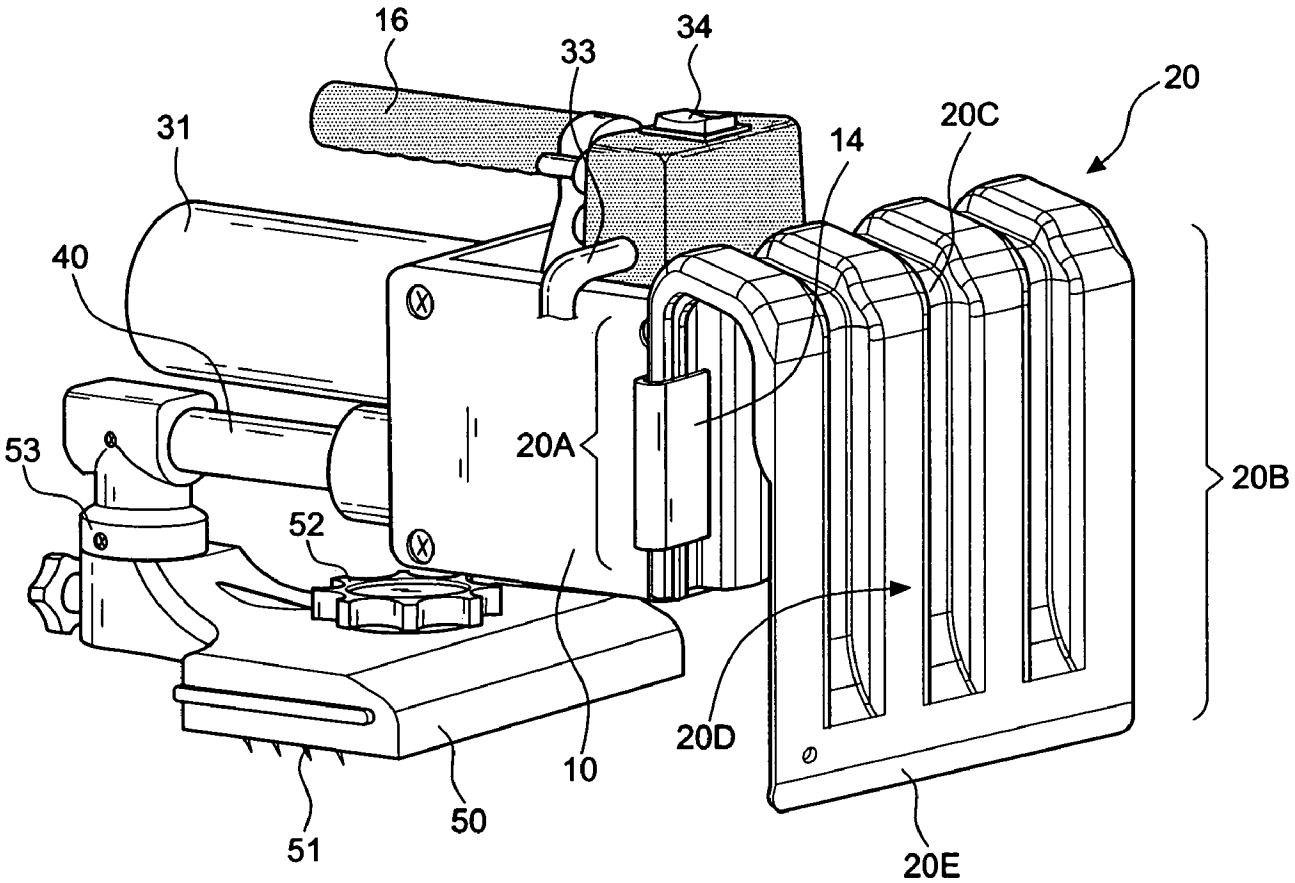
FIG. 6 is a perspective view of a preferred embodiment in accordance with the invention.
Figure 7:
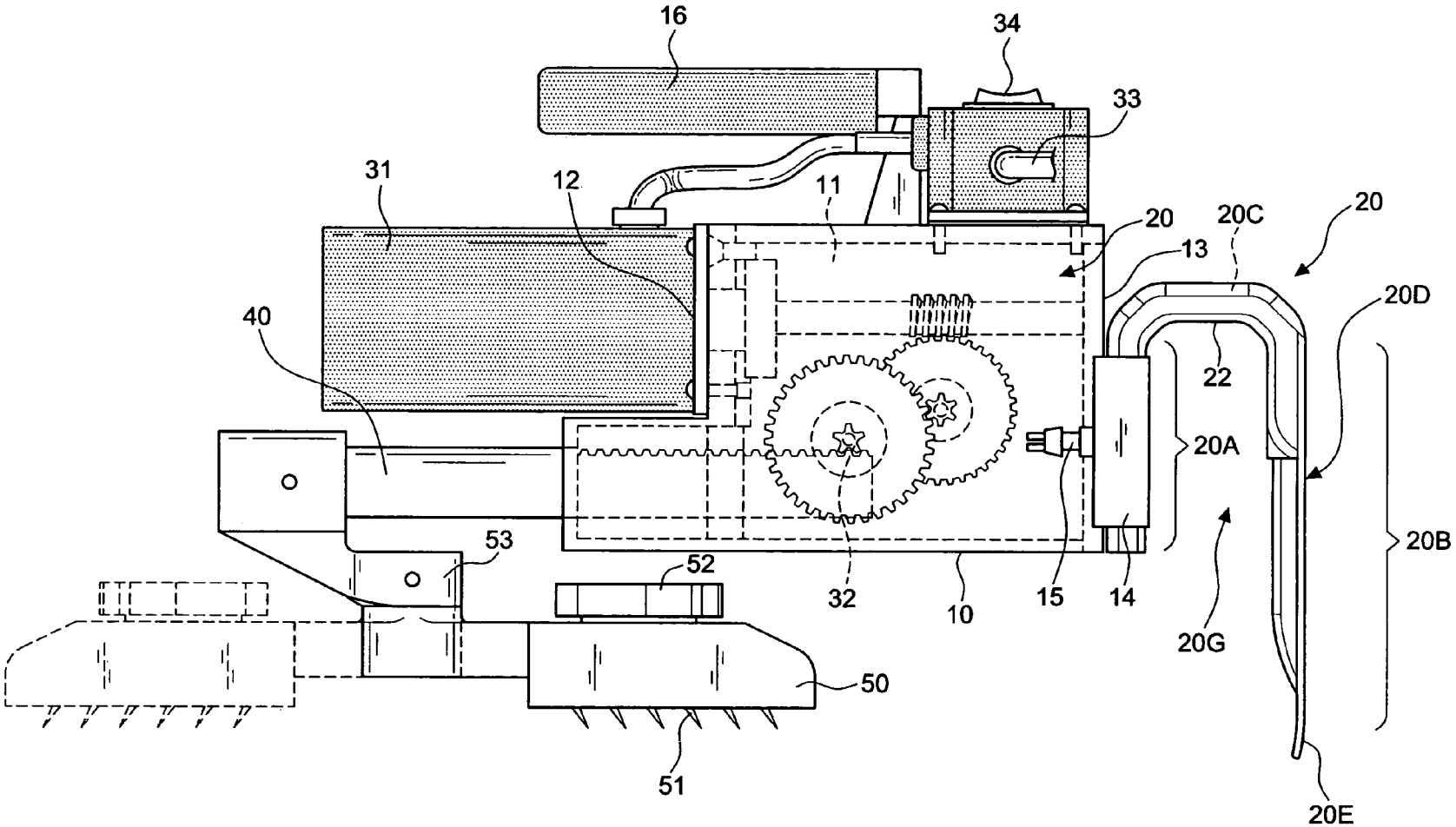
FIG. 7 is a side view of the preferred embodiment in accordance with the invention.

Referring to FIGS. 6 and 7, a preferred embodiment of the present invention includes a housing 10, a handle 16, a mini-motor 31, a gear rack 40, and a kicking unit 50.

The housing 10 includes a containing space 11, a front end 12 and a rear end 13. A change gear set 30 is disposed within the containing space 11. The handle 16 is positioned above the housing 10 and provided for a user to hold.

The mini-motor 31 is installed at the front end 12 of the housing 10 for driving the change gear set 30 within the housing 10.

The gear rack 40 is partially disposed within the housing 10 and engaged with a pinion 32 at the rear end of the change gear set 30. The gear rack 40 is driven by the pinion 32. The front portion of the gear rack 40 is extended from the front end 12 of the housing 10 and is linearly movable back and forth.

The kicking unit 50 is connected to a front end of the gear rack 40 and moved with the gear rack 40. The bottom surface of the kicking unit 50 has a plurality of protruding pins 51, and the top surface thereof has a knob 52.

Moreover, a rotating element 53 rotatable about 180 degree is interposed between the kicking unit 50 and the gear rack 40 such that the front end of the kicking unit 50 is rotatable in direction of a front/rear position.

In addition, the housing 10 has a power cord 33 for providing the mini-motor 31 with electric power and a control switch 34 for controlling the on/off state as well as the clockwise or anti-clockwise rotation of the mini-motor 31.

The above-mentioned is a prior art configuration. The invention is characterized in that the rear end of the housing 10 is provided with a receiving element 14 into which a 7-shaped hook member 20 is engaged. The 7-shaped hook member 20 includes an shorter internal portion 20A for engaging into the receiving element 14 in place and a longer external portion 20B for leaning against a wall in an upright state 20D. A flat hook portion 20E is formed at the bottom of the external portion 20B.

Besides, the 7-shaped hook member 20 includes a plurality of strengthening ribs 20C that are arranged in a non-flat and parallel manner in a vertical direction.

Meanwhile, the internal side of the receiving element 14 includes a locking element 15 for stably fixing the internal side of the 7-shaped hook member 20 on the handle 16.

Figure 8:
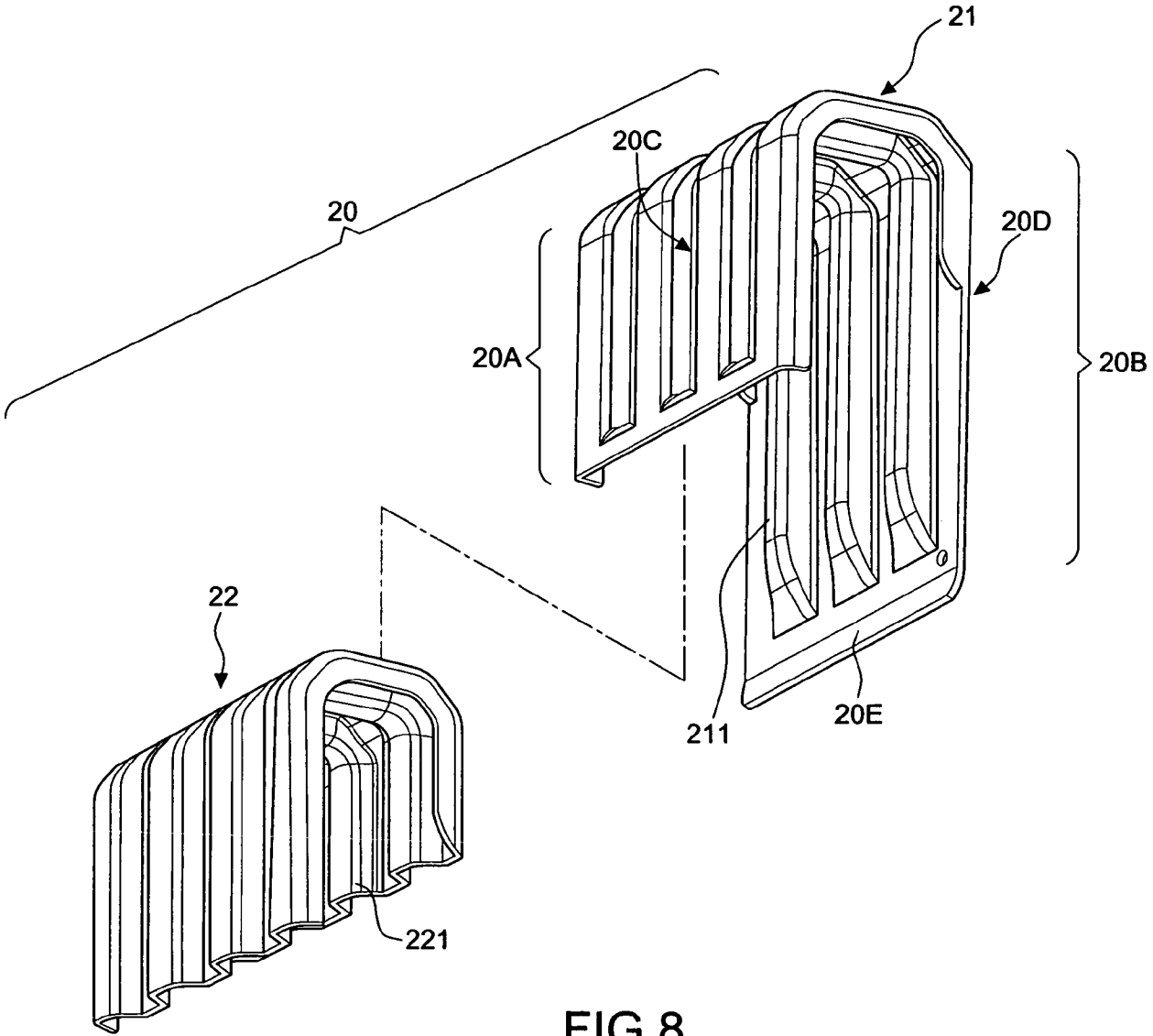
FIG. 8 is an exploded perspective view of a 7-shaped hook member in accordance with the invention.
Figure 9:
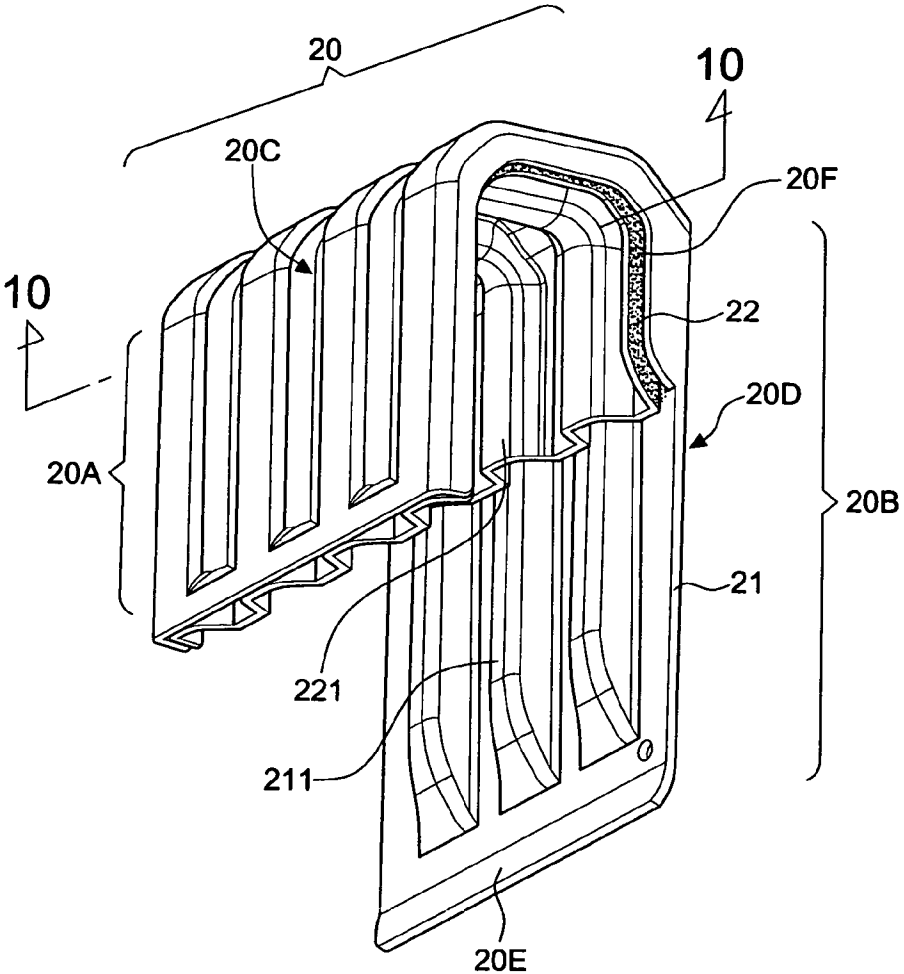
FIG. 9 is a perspective assembly view of the 7-shaped hook member in accordance with the invention.
Figure 10:
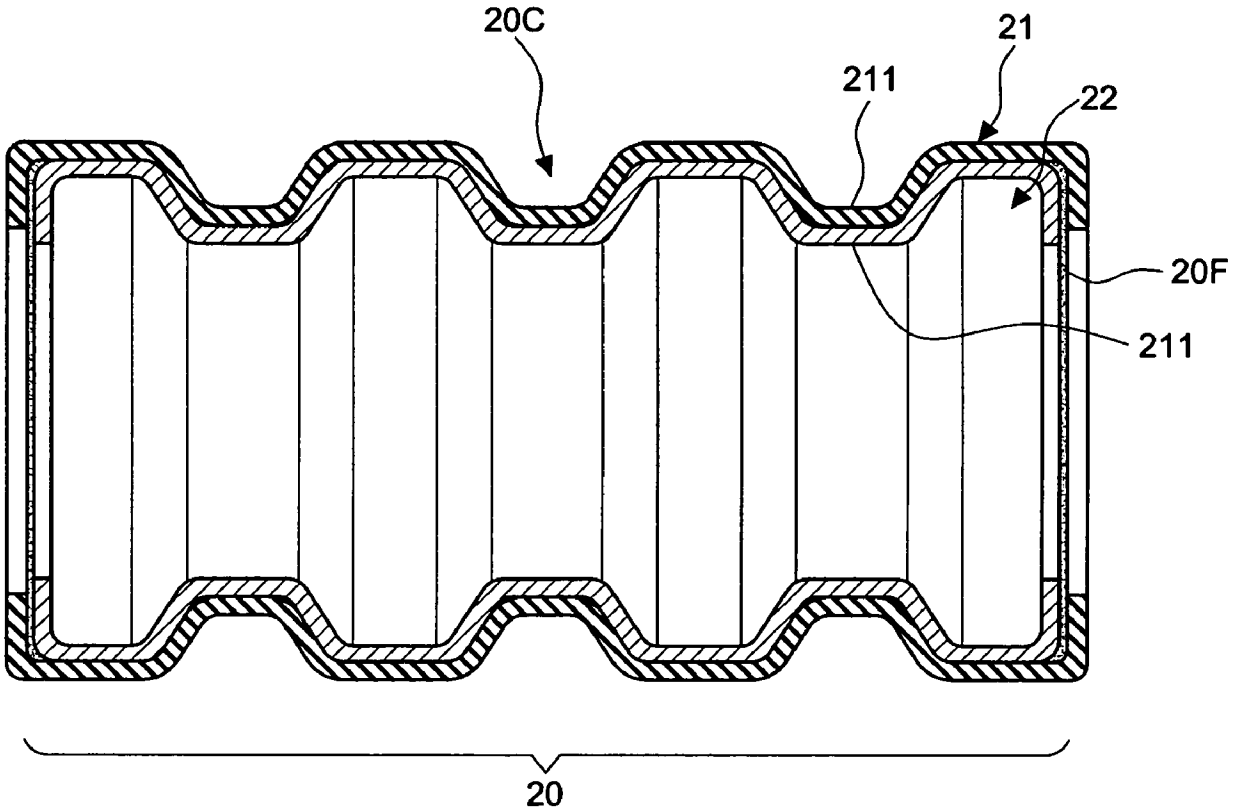
FIG. 10 is a cross-sectional view taken along the line 10-10 of FIG. 9.

As shown in FIGS. 8 through 10, the 7-shaped hook member 20 in accordance with a preferred embodiment of the invention includes an external 7-shaped piece 21 and an internal n-shaped piece 22 both of which are welded together (see the welded position 20F) to form an integral body. A plurality of first protruding ribs 211 are formed inwardly on the surface of the external 7-shaped piece 21 while the internal n-shaped piece 22 is provided with a plurality of second protruding ribs 221 opposing to the first protruding ribs 211. In this way, the strengthening ribs 20C are created when the first and second protruding ribs are coupled to one another. Accordingly, the 7-shaped hook member 20 is not heavy such that the whole body may be brought into equilibrium when the handle 16 is held to raise it. As a result, the human machine operating interface is more convenient and ergonomic. In addition, the strength of the 7-shaped hook member 20 is excellent due to its strengthening ribs 20C in coupling the external 7-shaped piece 21 and the internal n-shaped piece 22 together although the 7-shaped hook member 20 has less weight. Furthermore, the strength of the 7-shaped hook member 20 can ensure the upright state 20D of the external portion 20B thereof (see FIG. 7) and avoid the deformation after application of force. Besides, a receiving space 20G is created between the external portion 20B and the internal portion 20A for the lifting action of the carpet end.

Figure 1:
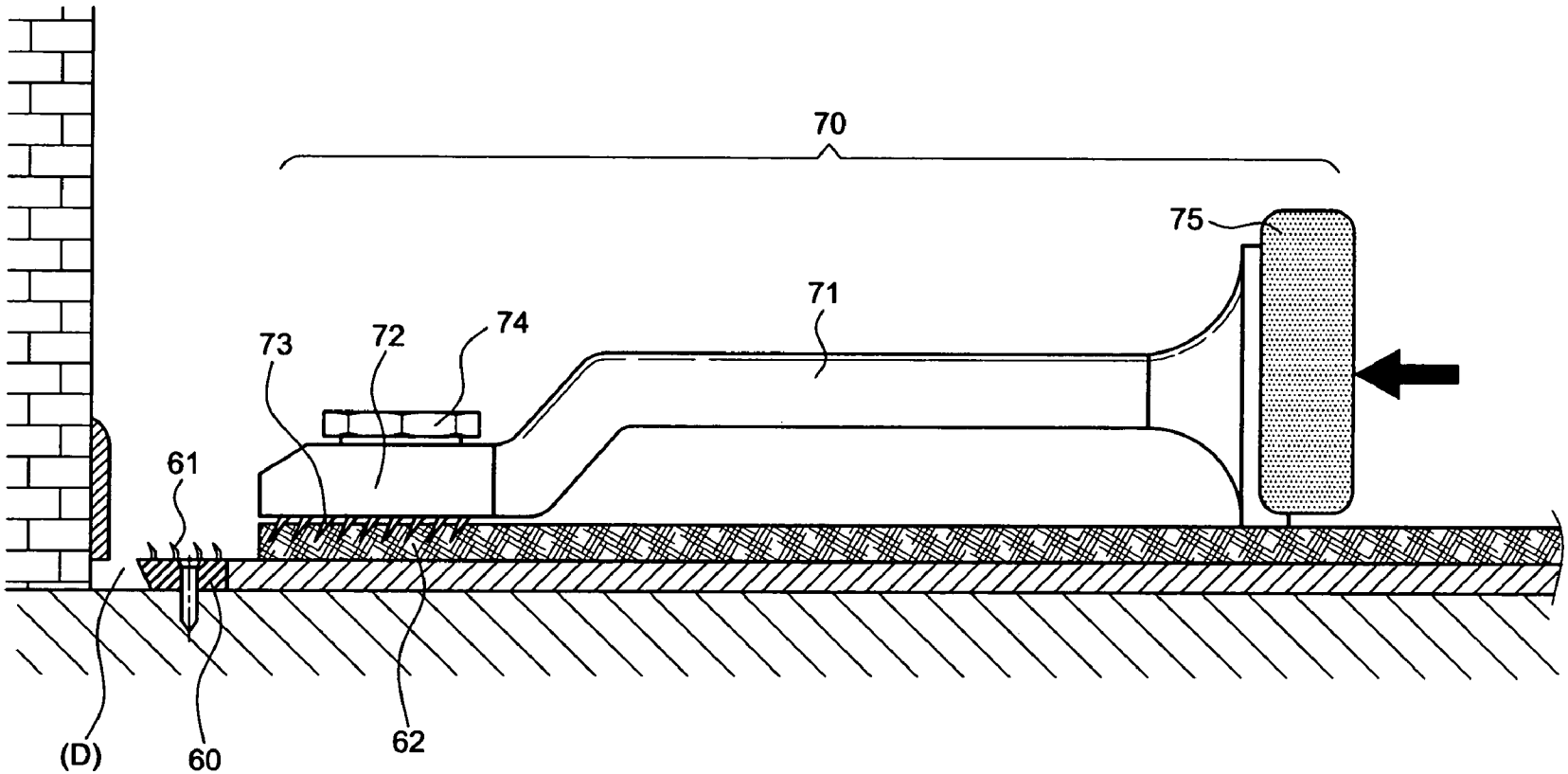
FIG.1 PRIOR ART
FIG. 1 is a schematic view of a prior art manual carpet kicker.
Figure 2:
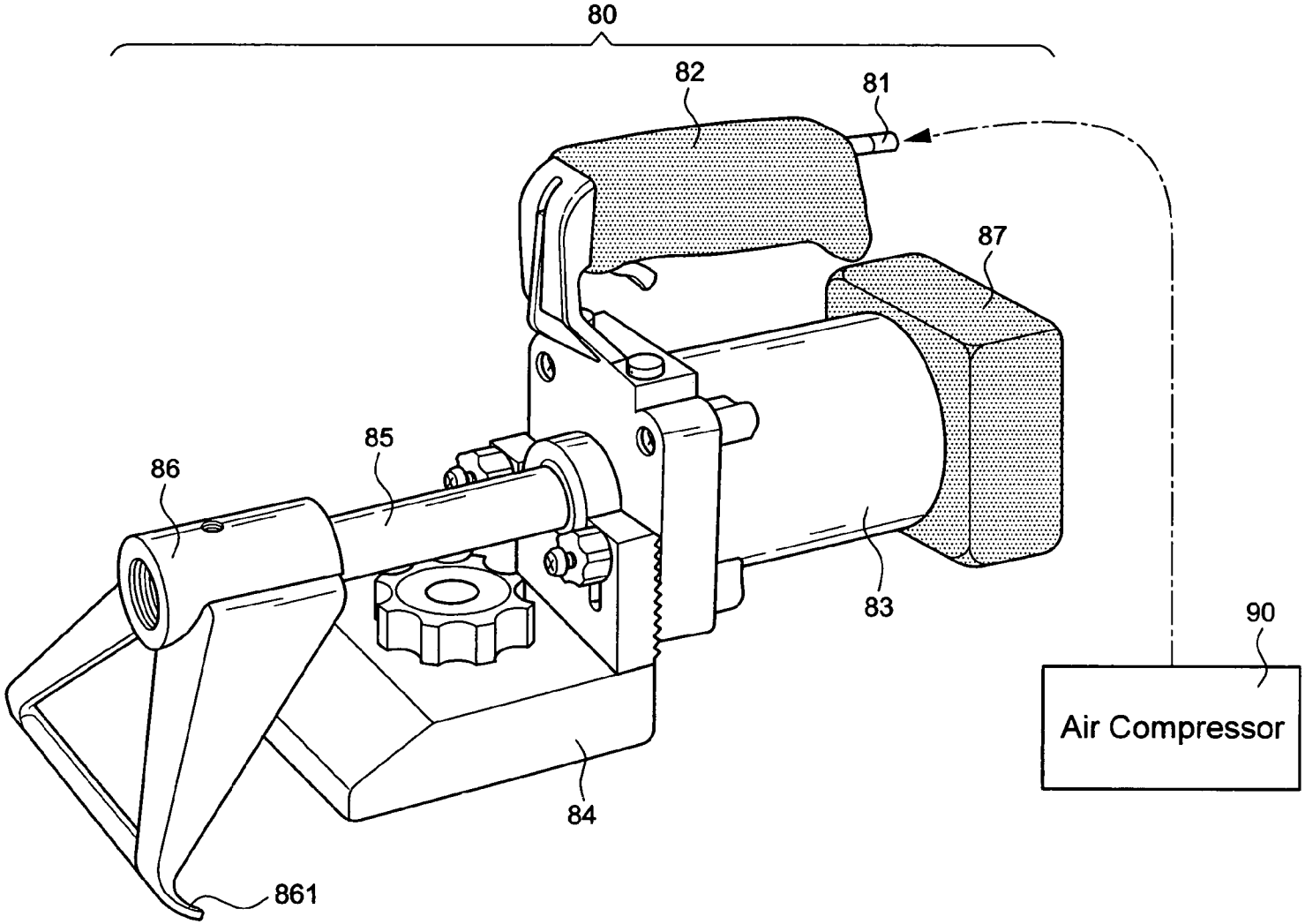
FIG.2 PRIOR ART
FIG. 2 is a perspective view of a prior art pneumatic carpet kicker.
Figure 3:
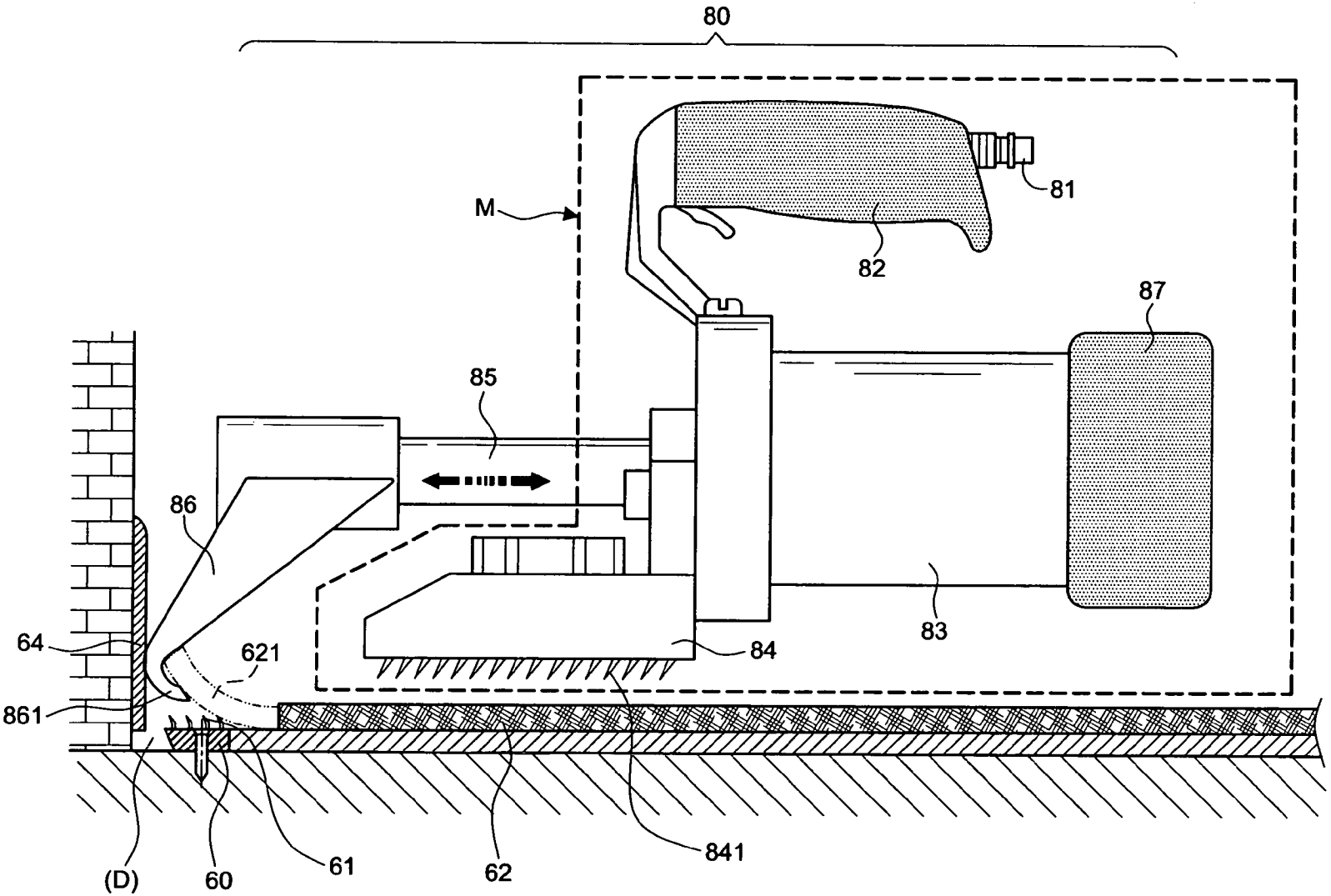
FIG.3 PRIOR ART
FIG. 3 is a schematic view of using a prior art pneumatic carpet kicker.
Figure 4:
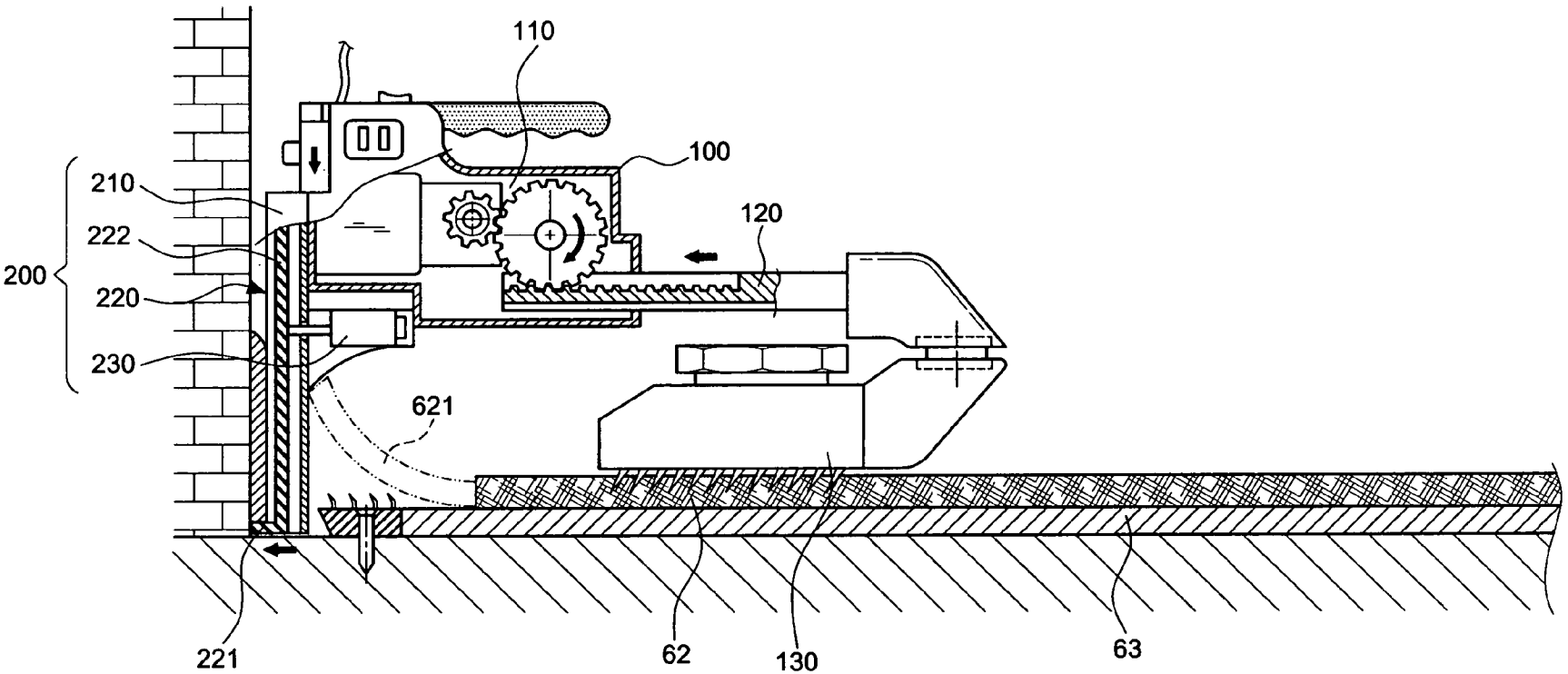
FIG.4 PRIOR ART
FIG. 4 is a schematic view of a carpet kicker in accordance with U.S. Pat. No. 7,222,898.
Figure 5:
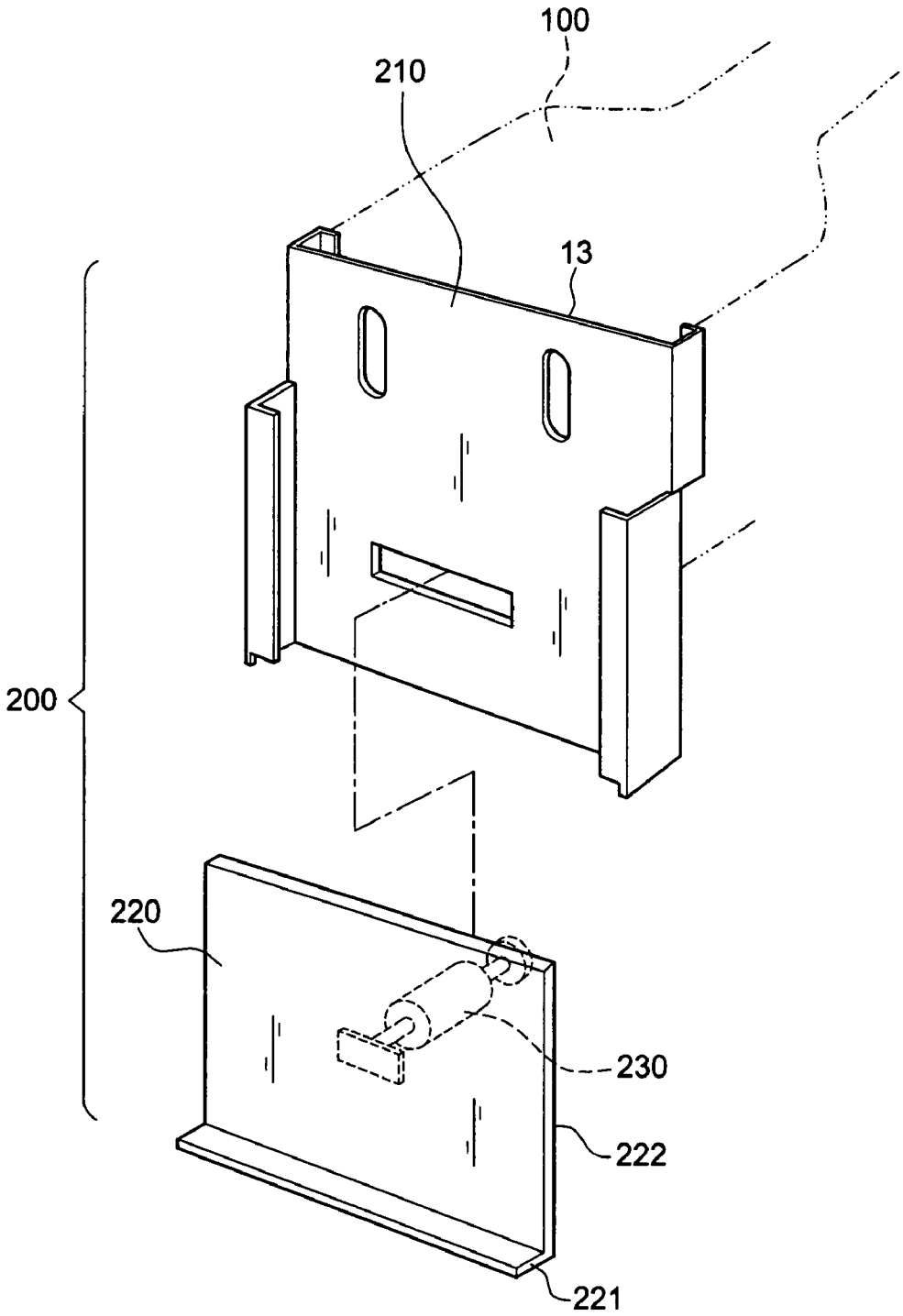
FIG.5 PRIOR ART
FIG. 5 is an exploded view of a positioning device in accordance with U.S. Pat. No. 7,222,898.
Figure 11:
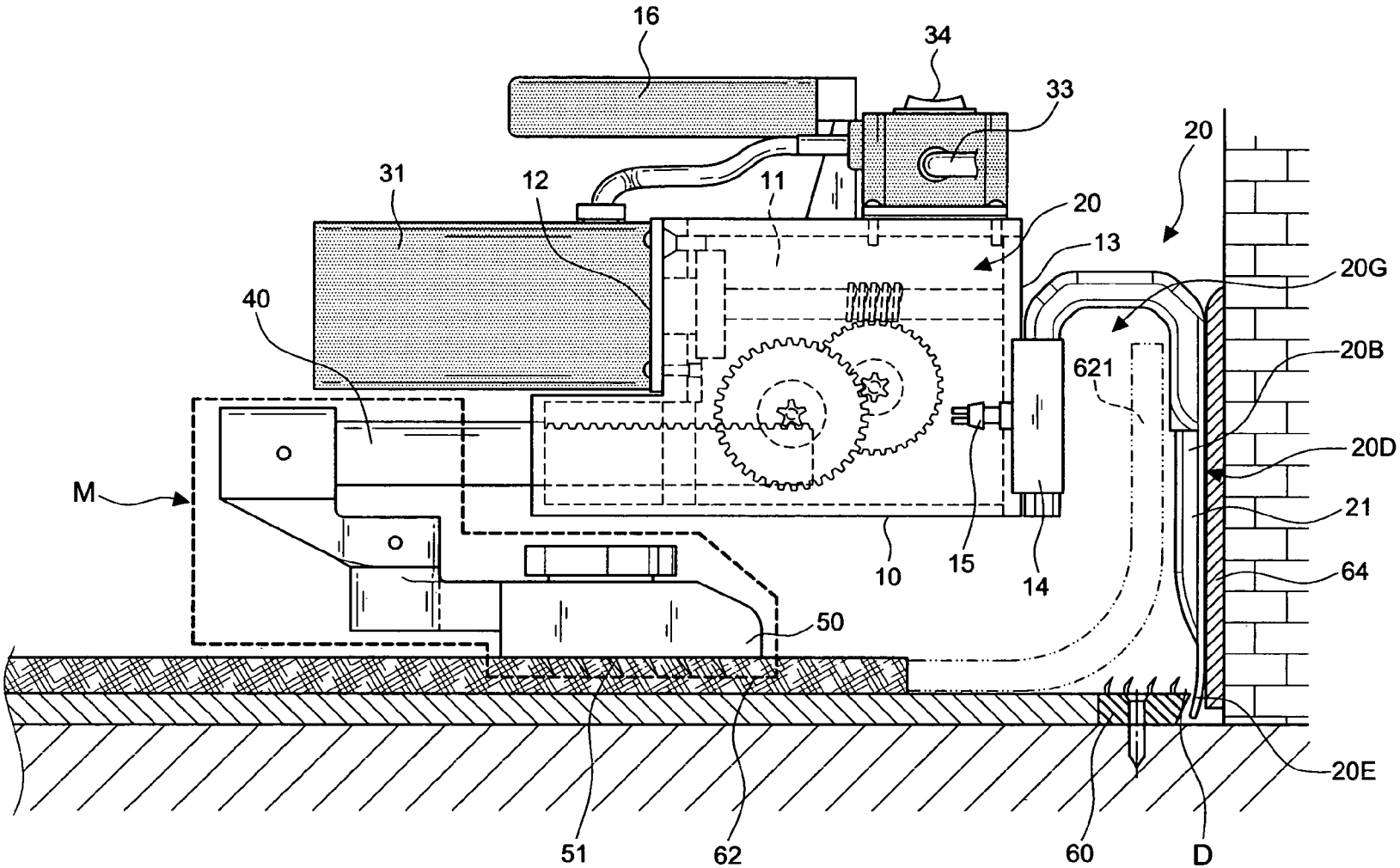
FIG. 11 is a schematic view of using the preferred embodiment of the invention.

As shown in FIG. 11, the external portion 20B of the 7-shaped hook member 20 is brought into the upright state 20D for leaning against a wall or a skirting board 64 by use of the positioning unit of the 7-shaped hook member 20. Meanwhile, the flat hook portion 20E at the tail of the 7-shaped hook member 20 can be smoothly inserted into a gap D for hooking the pin board 60 in place. Accordingly, the kicking unit 50 may be employed to spread the carpet 62. Compared with the structure according to FIG. 3, the flat hook portion 20E is easily hooked on the pin board 60. Moreover, the housing 10 and the mini-motor 31 stay unmoved such that the gear rack 40 pushes the kicking unit 50 to catch the carpet 62 and to move it in direction to the wall. As a result, only the elements within the dashed line are moved. Therefore, the application of the invention does not have the action in accordance with FIG. 3, and the problem thereof can be effectively resolved.

The most important is that the external portion 20B of the 7-shaped hook member 20 is completely leaned against the wall or the skirting board 64 in an upright state 20D. Thus, the housing 10 is not inclined, but closely and stably leaned against the wall when an external force acts on the kicking unit 50.

Furthermore, the receiving space 20G at the center of the 7-shaped hook member 20 won't block the lifting action of the front end 621 of the carpet. Accordingly, the spreading and positioning operation of the carpet 62 may be rapidly completed for a flat and nice appearance.

As a result, the conventional drawbacks can be removed by use of the positioning unit of the invention in match of the shifting mode of the kicking unit 50, such that the human machine operation interface is more convenient and the work can be done more stably and savely.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A positioning unit of a carpet kicker, comprising:

a) a housing having a containing space, a front end and a rear end, a change gear set being disposed within the containing space;

b) a handle positioned above the housing and provided for a user to hold;

c) a motor installed at the front end of the housing for driving the change gear set within the housing;

d) a gear rack partially disposed within the housing and engaged with a pinion at the rear end of the change gear set, the gear rack being driven by the pinion, a front portion of the gear rack being extended from the front end of the housing and linearly movable back and forth; and e) a kicking unit connected to a front end of the gear rack and moved with the gear rack, a bottom surface of the kicking unit having a plurality of protruding pins, and a top surface thereof having a knob, the kicking unit being angularly reversible in orientation relative to the gear rack;

wherein a rear end of the housing is provided with a receiving element into which a 7-shaped hook member is engaged, and the 7-shaped hook member includes an shorter internal portion for engaging into the receiving element in place and a longer external portion for leaning against a wall in an upright state, and a flat hook portion is formed at the bottom of the external portion; and wherein the 7-shaped hook member includes a plurality of strengthening ribs that are arranged in a non-flat and parallel manner in a vertical direction.

2. The positioning unit of a carpet kicker as recited in claim 1, wherein the internal side of the receiving element includes a locking element for fixing the internal side of the 7-shaped hook member.

3. The positioning unit of a carpet kicker as recited in claim 1, wherein the housing has a power cord and a control switch.

4. A positioning unit of a carpet kicker, comprising:

a) a housing having a containing space, a front end and a rear end, a change gear set being disposed within the containing space;

b) a handle positioned above the housing and provided for a user to hold;

c) a motor installed at the front end of the housing for driving the change gear set within the housing;

d) a gear rack partially disposed within the housing and engaged with a pinion at the rear end of the change gear set, the gear rack being driven by the pinion, a front portion of the gear rack being extended from the front end of the housing and linearly movable back and forth; and e) a kicking unit connected to a front end of the gear rack and moved with the gear rack, a bottom surface of the kicking unit having a plurality of protruding pins, and a top surface thereof having a knob;

wherein a rear end of the housing is provided with a receiving element into which a 7-shaped hook member is engaged, and the 7-shaped hook member includes an shorter internal portion for engaging into the receiving element in place and a longer external portion for leaning against a wall in an upright state, and a flat hook portion is formed at the bottom of the external portion; and wherein the 7-shaped hook member includes a plurality of strengthening ribs that are arranged in a non-flat and parallel manner in a vertical direction;

wherein the 7-shaped hook member includes an external 7-shaped piece and an internal n-shaped piece both of which are welded together to form an integral body, and wherein a plurality of first protruding ribs are formed inwardly on the surface of the external 7-shaped piece while the internal n-shaped piece is provided with a plurality of second protruding ribs opposing to the first protruding ribs.

5. A positioning unit of a carpet kicker, comprising:

a) a housing having a containing space, a front end and a rear end, a change gear set being disposed within the containing space;

b) a handle positioned above the housing and provided for a user to hold;

c) a motor installed at the front end of the housing for driving the change gear set within the housing;

d) a gear rack partially disposed within the housing and engaged with a pinion at the rear end of the change gear set, the gear rack being driven by the pinion, a front portion of the gear rack being extended from the front end of the housing and linearly movable back and forth; and e) a kicking unit connected to a front end of the gear rack and moved with the gear rack, a bottom surface of the kicking unit having a plurality of protruding pins, and a top surface thereof having a knob;

wherein a rear end of the housing is provided with a receiving element into which a 7-shaped hook member is engaged, and the 7-shaped hook member includes an shorter internal portion for engaging into the receiving element in place and a longer external portion for leaning against a wall in an upright state, and a flat hook portion is formed at the bottom of the external portion; and wherein the 7-shaped hook member includes a plurality of strengthening ribs that are arranged in a non-flat and parallel manner in a vertical direction;

wherein a rotating element rotatable about 180 degree is interposed between the kicking unit and the gear rack, whereby the front end of the kicking unit is rotatable between front and rear directed positions.

* * * * *